US007644516B2

(12) United States Patent
Chung

(10) Patent No.: US 7,644,516 B2
(45) Date of Patent: Jan. 12, 2010

(54) CLOTHES DRYING MACHINE

(75) Inventor: Young Suk Chung, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 402 days.

(21) Appl. No.: 11/077,155

(22) Filed: Mar. 11, 2005

(65) Prior Publication Data

US 2005/0235519 A1 Oct. 27, 2005

(30) Foreign Application Priority Data

Apr. 21, 2004 (KR) ..... 10-2004-0027624
Apr. 21, 2004 (KR) ..... 10-2004-0027627
Apr. 21, 2004 (KR) ..... 10-2004-0027628
Apr. 21, 2004 (KR) ..... 10-2004-0027629

(51) Int. Cl.
*F26B 11/02* (2006.01)
*F26B 3/34* (2006.01)

(52) U.S. Cl. ..... 34/604; 34/607; 34/140

(58) Field of Classification Search ..... 34/604, 34/607, 134, 138, 140
See application file for complete search history.

(56) References Cited

U.S. PATENT DOCUMENTS 3,983,754 A * 10/1976 Deguchi et al. ..... 361/162
4,622,759 A 11/1986 Abe et al.
4,840,285 A 6/1989 Carr
5,042,170 A 8/1991 Hauch et al.
5,158,446 A * 10/1992 Hall ..... 431/20
5,245,764 A 9/1993 Sung
5,555,647 A 9/1996 Torborg et al.
5,682,684 A 11/1997 Wentzlaff et al.
5,899,005 A 5/1999 Chen et al.

FOREIGN PATENT DOCUMENTS

CN 9-225196 9/1997
DE 197 04 213 9/1998
DE 19755916 6/1999
EP 1 380 683 A2 1/2004

(Continued)

OTHER PUBLICATIONS

European Search Report dated Jun. 30, 2006 issued with respect to European Application No. 05250385.1-2314.

(Continued)

*Primary Examiner*—Jiping Lu
(74) *Attorney, Agent, or Firm*—Staas & Halsey LLP

(57) ABSTRACT

A clothes drying machine having a temperature sensor that may be easily repaired or replaced. The clothes drying machine includes a housing forming an external appearance of the clothes drying machine, a drying tub rotatably mounted in the housing, a hot air introducing duct to introduce hot air into the drying tub, a hot air discharging duct to discharge the hot air out of the drying tub, and a temperature sensor mounted at the front part of the hot air discharging duct to detect the temperature of the hot air passing through the hot air discharging duct. The temperature sensor is mounted at the front part of the hot air discharging duct so that an operator has easy access to the temperature sensor. Consequently, repair or replacement of the temperature sensor may be easily and conveniently performed.

26 Claims, 4 Drawing Sheets

FOREIGN PATENT DOCUMENTS

| | | | | |
|---|---|---|---|---|
| EP | 1 380 683 | A3 | | 2/2006 |
| JP | 02307727 | A | * | 12/1990 |
| JP | 04-348800 | | | 3/1992 |
| JP | 9-94397 | | | 4/1997 |
| JP | 10-216392 | | | 8/1998 |
| KR | 2003-0071804 | | | 6/2003 |

OTHER PUBLICATIONS

Chinese Office Action issued with respect to Chinese Patent Application No. 2005100072049, which corresponds to the above referenced application.

* cited by examiner

CLOTHES DRYING MACHINE

CROSS-REFERENCE TO RELATED APPLICATIONS

This application claims the benefit of Korean Patent Application No. 2004-27624, filed on Apr. 21, 2004, Korean Patent Application No. 2004-27627, filed on Apr. 21, 2004, Korean Patent Application No. 2004-27628, filed on Apr. 21, 2004 and Korean Patent Application No. 2004-27629, filed on Apr. 21, 2004 in the Korean Intellectual Property Office, the disclosures of which are incorporated herein by reference.

BACKGROUND OF THE INVENTION

1. Field of the Invention

The present invention relates to a clothes drying machine, and, more particularly, to a clothes drying machine having a temperature sensor to detect the temperature of hot air passing through a hot air discharging duct, wherein the temperature sensor may be easily repaired or replaced.

2. Description of the Related Art

Generally, a clothes drying machine is a machine that forcibly blows hot air into a drying tub to dry the wet laundry put in the drying tub. The hot air, which is heated by a heater and a blowing fan, is forcibly introduced into the drying tub to dry the laundry.

A conventional clothes drying machine comprises: a housing having a door attached to the front part thereof; a drying tub formed in the shape of a cylinder and mounted horizontally in the housing; a hot air introducing duct having one end mounted at the rear of the drying tub and having a heater mounted therein to heat air, which is introduced to the drying tub, a hot air discharging duct to discharge the hot air out of the drying tub, and a blowing fan mounted halfway in the hot air discharging duct to generate a suction force and a blowing force.

Also, the conventional clothes drying machine is provided with a temperature sensor to detect the temperature of the hot air passing through the hot air discharging duct to control the operation of the clothes drying machine.

In the conventional clothes drying machine, the temperature sensor is ordinarily mounted to the side or the rear of the hot air discharging duct. When the temperature sensor is to be repaired or replaced as time goes by, separating the drying tub, which is disposed above the hot air discharging duct, from the housing before the temperature sensor is repaired or replaced is necessary. Consequently, the repair or replacement of the temperature sensor is difficult.

SUMMARY OF THE INVENTION

Therefore, an aspect of the invention provides a clothes drying machine having a temperature sensor that may be easily repaired or replaced.

In accordance with one aspect, the present invention provides a clothes drying machine, comprising: a housing forming an external appearance of the clothes drying machine; a drying tub rotatably mounted in the housing; a hot air introducing duct to introduce hot air into the drying tub; a hot air discharging duct to discharge the hot air out of the drying tub; and a temperature sensor mounted at the front part of the hot air discharging duct to detect the temperature of the hot air passing through the hot air discharging duct.

In accordance with another aspect, the present invention provides a clothes drying machine, comprising: a housing forming an external appearance of the clothes drying machine; a drying tub rotatably mounted in the housing; a hot air introducing duct to introduce hot air into the drying tub; a hot air discharging duct to discharge the hot air out of the drying tub; a temperature sensor to detect the temperature of the hot air passing through the hot air discharging duct; and a closing member detachably fixed to the hot air discharging duct, wherein the temperature sensor is attached to the closing member.

In another aspect of the invention, the clothes drying machine further comprises: an engaging unit formed at the closing member and the hot air discharging duct in the shape of grooves and protrusions to engage the edge of the closing member with the edge of the cleaning hole of the hot air discharging duct.

In accordance with yet another aspect, the present invention provides a clothes drying machine, comprising: a housing; a drying tub rotatably mounted in the housing; a hot air introducing duct to introduce hot air into the drying tub; a hot air discharging duct to discharge the hot air out of the drying tub; and a transparent window made of a transparent material, the transparent window being part of the hot air discharging duct.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
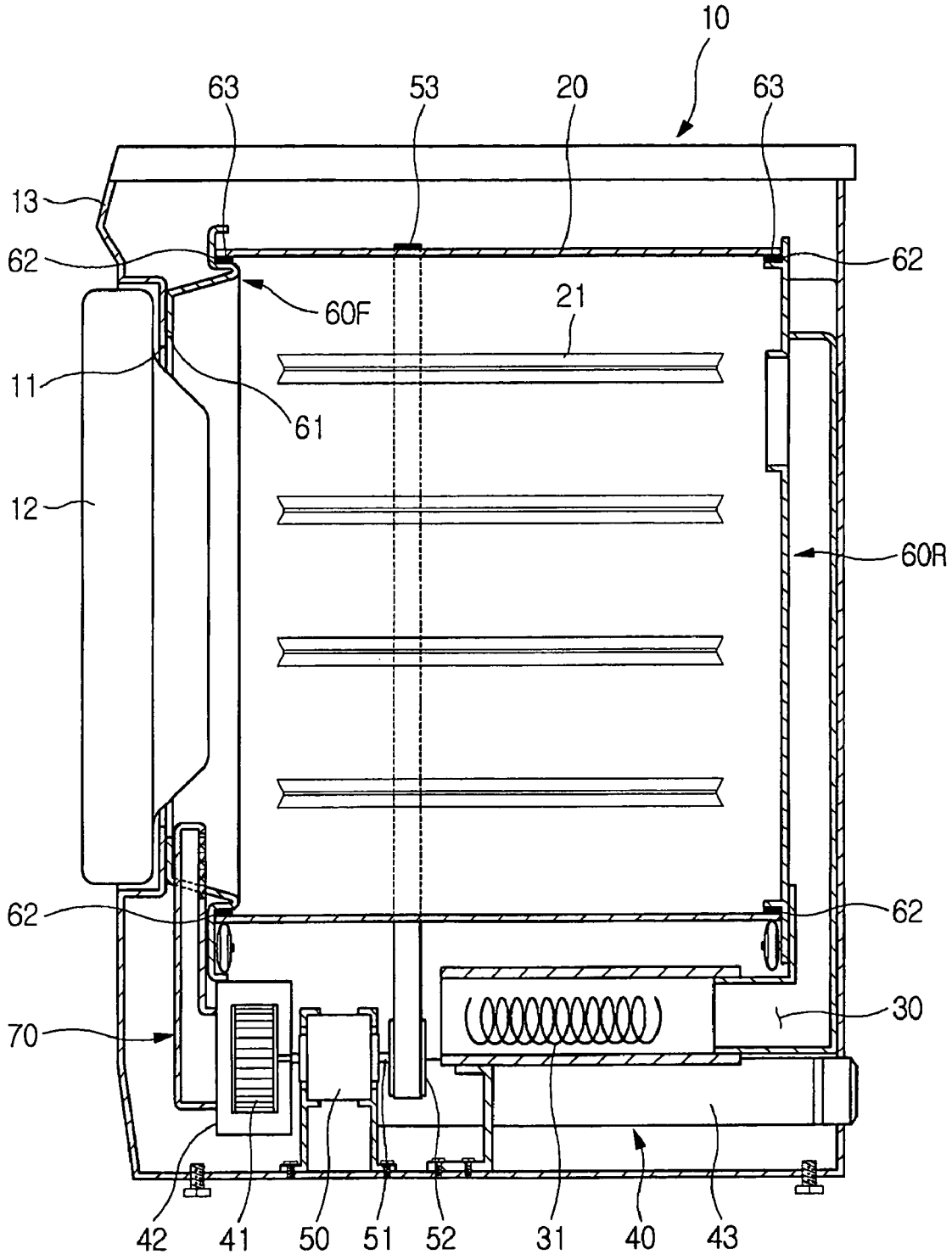
FIG. 1 is a perspective view showing a clothes drying machine according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
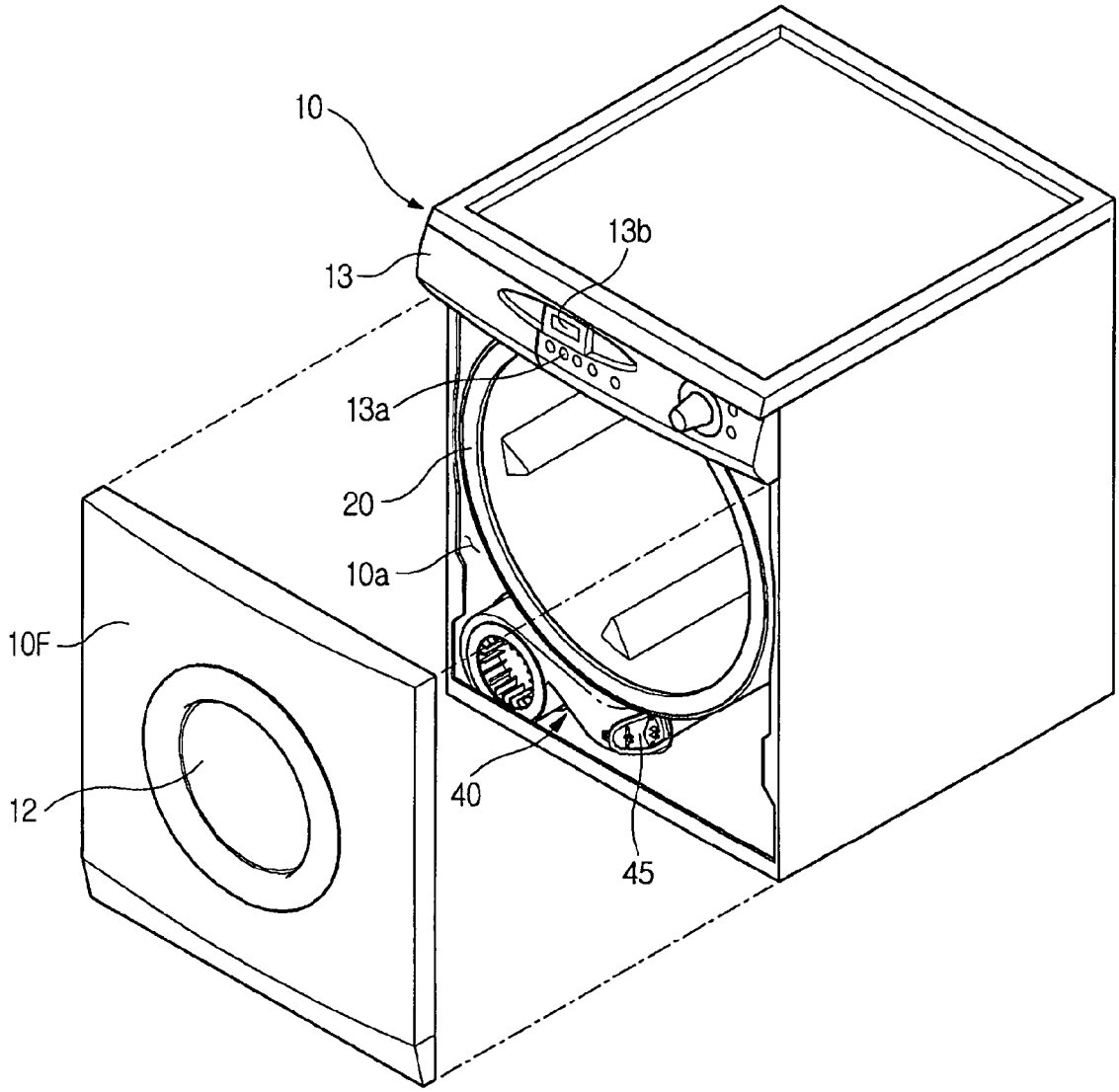
FIG. 2 is an exploded perspective view, in part, of the clothes drying machine of FIG. 1 showing a hot air discharging duct mounted in the clothes drying machine.

As shown in FIGS. 1 and 2, a clothes drying machine according to an embodiment of the present invention comprises: a housing 10 forming an external appearance of the clothes drying machine; a drying tub 20 formed in the shape of a drum and rotatably mounted in the housing 10; a hot air introducing duct 30 to introduce hot air into the drying tub 20; and a hot air discharging duct 40 to discharge the hot air out of the drying tub 20.

A laundry-insertion hole 11 is formed at the front part of the housing 10 to allow the laundry to be inserted into and withdrawn from the drying tub therethrough. A hinged door 12 is attached to the front part of the housing 10 to close the laundry-insertion hole 11. A control panel 13 having control buttons 13*a* are disposed at the upper front part of the housing 10 to control the operation of the clothes drying machine and a display unit 13*b* to display the operation of the clothes drying machine.

Since the clothes drying machine is too heavy to carry, the front part of the housing 10 is partly or wholly opened so that a repair of internal components of the clothes drying machine may be performed through the front of the housing 10 once the clothes drying machine is installed. As shown in FIGS. 1 and 2, an opening 10*a* is formed at the front part of the housing 10. The opening 10*a* is covered by means of a front cover 10F, which is detachably attached to the front part of the housing 10.

The hot air introducing duct 30 includes a heater 31 mounted therein to heat air passing through the hot air introducing duct 30. One end of the hot air introducing duct 30 is open, and the other end of the hot air introducing duct 30 is connected to the drying tub 20 so that the hot air may be supplied to the drying tub 20. The hot air discharging duct 40 includes a blowing fan 41 mounted halfway therein to generate a suction force and a blowing force. The hot air is discharged out of the clothes drying machine via the hot air introducing duct 30, the drying tub 20, and the hot air discharging duct 40 by the blowing fan 41.

The drying tub 20 is rotatably mounted in the housing 10. The drying tub 20 is rotated by a driving motor 50 mounted to the inner lower part of the housing 10 via a belt 53. The driving motor 50 drives the drying tub 20 and the blowing fan 41 at the same time. To this end, the driving motor 50 has a rotary shaft 51 directly connected to the blowing fan 41 at one end thereof so that the blowing fan 41 may be rotated. The other end of the rotary shaft 51 is connected to a pulley 52. The pulley 52 allows a rotating force to rotate the drying tub 20 to be transmitted to the drying tub 20 via the belt 53, which surrounds the drying tub 20. Reference numeral 21 indicates lifting blades 21 protruded inwardly from the inner surface of the drying tub 20 to lift the laundry.

A front panel 60F is attached to the front of the drying tub 20 to rotatably support the front end of the drying tub 20 while the front panel 60F covers the front part of the drying tub 20. A rear panel 60R is attached to the rear of the drying tub 20 to rotatably support the rear end of the drying tub 20 while the rear panel 60R covers the rear part of the drying tub 20.

The front panel 60F includes a ring-shaped supporting member 62 to rotatably support the inner circumference of the drying tub 20. Similarly, the rear panel 60R includes another ring-shaped supporting member 62 to rotatably support the inner circumference of the drying tub 20. Friction pads 63, each having a low coefficient of friction, are respectively disposed at the outer circumferences of the front and rear panels 60F and 60R and are attached to supporting members 62. The friction pads 63 and the supporting members 62 cooperate to support the front and rear ends of the drying tub 20 at the front and rear panels 60F and 60R, respectively. Consequently, when the rotating force from the driving motor 50 is transmitted to the drying tub 20, the drying tub 20 is rotated while the front and rear ends of the drying tub 20 are slid along the friction pads 63 disposed at the front and rear panels 62, respectively.

The hot air introducing duct 30 is provided at the rear panel 60R so as to introduce the hot air into the drying tub 20. The hot air discharging duct 40 is provided at the front panel 60F so as to discharge the hot air out of the drying tub 20. Consequently, the hot air is moved from the rear of the drying tub 20, where the hot air introducing duct 30 is mounted, to the front of the drying tub 20, where the hot air discharging duct 40 is mounted, so that the laundry in the drying tub 20 may be dried.

The front panel 60F is provided with a through-hole 61, through which the laundry is inserted into and withdrawn from the drying tub. Specifically, the through-hole 61 is formed at the inner side of the ring-shaped supporting member 62. A grill member 70, which is connected to the hot air discharging duct 40, is disposed below the front panel 60F. The grill member 70 is formed in the shape of a grid to prevent the laundry from being introduced into the hot air discharging duct 40 so that only the hot air is introduced into the hot air discharging duct 40.

Figure 3:
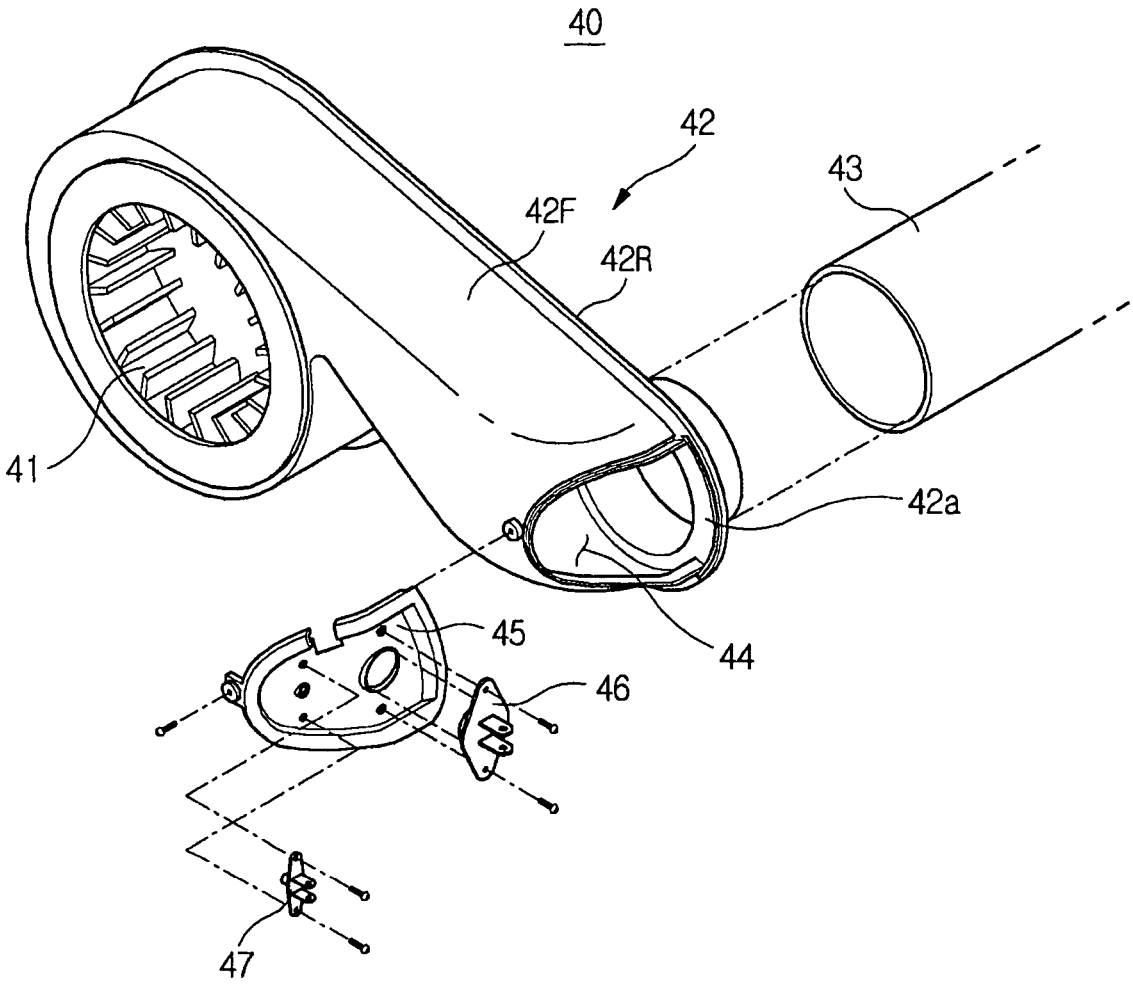
FIG. 3 is an exploded perspective view showing the hot air discharging duct of the clothes drying machine of FIG. 1.

As shown in FIG. 3, the hot air discharging duct 40, which is connected to the grill member 70, disposed at the inner lower front part of the housing 10, includes a side-extension duct part extending toward one side of the housing and a rear-extension duct part connected with the side-extension duct part and extending toward the rear of the housing so that the hot air, which is guided from the drying tub 20 via the grill member 70, is discharged out of the clothes drying machine.

Specifically, the hot air discharging duct 40 comprises: a fan casing 42 that is connected to the lower end of the grill member 70. The blowing fan 41 is mounted in the fan casing 42 and includes one end to extend toward one side of the housing so that the hot air is guided toward the side of the housing; and a discharging pipe 43 connected to the end of the fan casing 42 to extend toward the rear of the housing. The end of the fan casing 42 is bent so that the hot air may be guided toward the rear of the housing. The fan casing 42 includes a front case 42F, formed such that the front case 42F has a prescribed space, having an open rear part, and a rear case 42R to cover the open rear part of the front case 42F. A cleaning hole 44 is formed at the end of the front case 42F, which extends toward the side of the housing.

A temperature sensor 46 is mounted to the hot air discharging duct 40 to detect the temperature of the hot air passing through the hot air discharging duct 40. The temperature sensor 46 is detachably fixed to the hot air discharging duct 40 by fixing members, such as screws. The temperature sensor 46 is disposed at the front part of the hot air discharging duct 40 so that repair or replacement of the temperature sensor 46 may be performed from the front of the hot air discharging duct 40. According to this embodiment, the opening 10 and the front cover 10F are provided at the front part of the housing 10, although, of course, other embodiments and arrangements are possible. Consequently, an operator may easily repair or replace the temperature sensor 46 mounted to the hot air discharging duct 40 in front of the hot air discharging duct 40 through the opening 10*a* once the front cover 10F is removed.

In an embodiment of the invention, an auxiliary temperature sensor 47 may be mounted to the hot air discharging duct 40 to intercept electric current that is supplied to the heater 31 when the temperature of the hot air exceeds a prescribed value. In this embodiment, the auxiliary temperature sensor 47 is disposed at the front part of the hot air discharging duct 40 while being adjacent to the temperature sensor 46 and exposed toward the opening 10*a* in the same manner as the temperature sensor 46. Consequently, the auxiliary temperature sensor 47 may be easily repaired or replaced through the front of the housing 10 through the opening 10*a*.

The interior of the hot air discharging duct 40 is cleaned through the cleaning hole 44, which is formed at the hot air discharging duct 40 such that the inside of the hot air discharging duct 40 communicates with the outside of the hot air discharging duct 40. The cleaning hole 44 is covered by a closing member 45, which is normally attached to the hot air discharging duct 40 so that the hot air may be moved through the hot air discharging duct 40. When the interior of the hot air discharging duct 40 is to be cleaned, the closing member 45 may be removed from the hot air discharging duct 40 so that the interior of the hot air discharging duct 40 may be cleaned through the cleaning hole 44.

The closing member 45 includes a curved inner surface, which corresponds to the bent part of the hot air discharging duct 40, so that the closing member 45 may cover the entirety of the bent part of the hot air discharging duct 40. Consequently, the flow direction of the hot air may be smoothly changed at the bent part of the hot air discharging duct 40.

The temperature sensor 46 and the auxiliary temperature sensor 47 are detachably fixed to the closing member 45 by fixing members, such as screws. This is because the flow speed of the hot air is relatively decreased due to flow resistance when the flow direction of the hot air is changed at the bent part of the hot air discharging duct 40. Consequently, when the temperature sensor 46 and the auxiliary temperature sensor 47 are fixed to the closing member 45, which is disposed at the bent part of the hot air discharging duct 40, the period of time during which the hot air contacts the temperature sensor 46 and the auxiliary temperature sensor 47 is increased to accurately measure the temperature of the hot air. Also, the closing member 45 is easily removed from the hot air discharging duct 40 in a forward direction. Thus, the temperature sensor 46 and the auxiliary temperature sensor 47 may also be separated from the hot air discharging duct 40 and then removed from the housing 10 through the opening 10*a*. Consequently, the temperature sensor 46 and the auxiliary temperature sensor 47 may be easily repaired or replaced.

According to this embodiment, the closing member 45 is made of a transparent material so that the closing member 45 serves as a transparent window. When a user sees, by looking through the closing member 45, that dust or the like is accumulated in the hot air discharging duct 40, the closing member 45 may be separated from the hot air discharging duct 40 so that the cleaning hole 44 is opened. Consequently, the interior of the hot air discharging duct 40 may be easily cleaned through the cleaning hole 44.

Here, it is noted that there is a possibility that hot air may leak from between the closing member 45 and the hot air discharging duct 40 while the cleaning hole 44 is closed by the closing member 45. When the hot air leaks from between the closing member 45 and the hot air discharging duct 40, the internal components of the clothes drying machine may be damaged due to the leaking hot air and moisture contained in the leaking hot air.

In order to prevent the hot air from leaking from between the closing member 45 and the hot air discharging duct 40, the clothes drying machine according to the present invention is provided with an engaging unit to engage the edge of the closing member 45 with the edge of the cleaning hole 44 of the hot air discharging duct 40.

Figure 4:
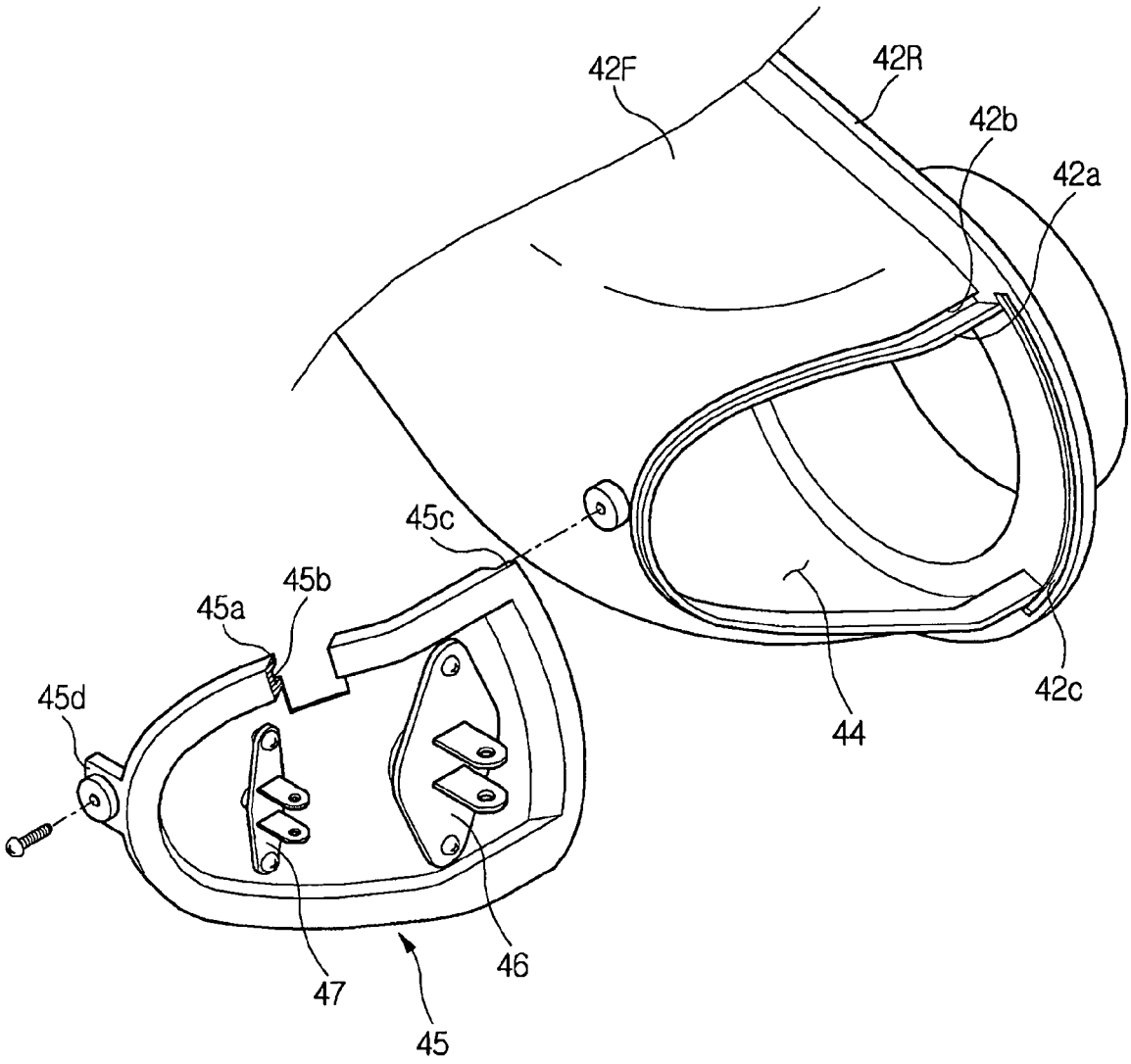
FIG. 4 is an exploded perspective view of the hot air discharging duct of the clothes drying machine of FIG. 1 and a closing member attached to the hot air discharging duct.

As shown in FIG. 4, the engaging unit comprises engaging protrusions 42*a* and 45*a* and engaging grooves 45*b* and 42*b*, in which the engaging protrusions 42*a* and 45*a* are engaged, respectively. The engaging protrusions 42*a* and 45*a* and the engaging grooves 45*b* and 42*b* are provided at the edges of the cleaning hole 44 of the hot air discharging duct 40 and the closing member 45, respectively, such that the engaging protrusions 42*a* and 45*a* may be engaged in the corresponding engaging grooves 45*b* and 42*b*. Specifically, the engaging protrusion 45*a* of the closing member 45 is engaged in the engaging groove 42*b* of the hot air discharging duct 40, and the engaging protrusion 42*a* of the hot air discharging duct 40 is engaged in the engaging groove 45*b* of the closing member 45.

As is described above, the engaging protrusions 42*a* and 45*a* are provided at the edge of the cleaning hole 44 of the hot air discharging duct 40 and the edge of the closing member 45 while extending along the cleaning hole 44 of the hot air discharging duct 40 and the edge of the closing member 45. The engaging grooves 42*b* and 45*b* are provided inside the engaging protrusions 42*a* and 45*a*, respectively, while extending in parallel with the engaging protrusions 42*a* and 45*a*. Consequently, the edge of the closing member 45 is entirely engaged with the edge of the cleaning hole 44 of the hot air discharging duct 40.

Pluralities of supporting protrusions 45*c*, to protrude outwardly, are formed at the rear end of the closing member 45. A supporting groove 42*c*, in which the supporting protrusions 45*c* are formed and in which the supporting protrusions 45*c* are securely located, is formed at the front surface of the rear case 42R so that the rear end of the closing member 45 may be supported by the rear case 42R. A fixing hole 45*d*, through which a fixing member, such as a screw, is inserted, is formed at the front end of the closing member 45 so that the closing member 45 may be attached to the hot air discharging duct 40 by the fixing member.

As is apparent from the above description, the present invention provides a clothes drying machine having a temperature sensor mounted at the front part of a hot air discharging duct so that an operator has easy access to the temperature sensor. Consequently, repair or replacement of the temperature sensor may be easily and conveniently performed.

A closing member, to which the temperature sensor and an auxiliary temperature sensor of the clothes drying machine are fixed, is detachably attached to the hot air discharging duct such that the temperature sensor and the auxiliary temperature sensor may be withdrawn out of a housing of the clothes drying machine when the closing member is separated from the hot air discharging duct. Consequently, repair or replacement of the temperature sensor may be easily and conveniently performed.

Furthermore, the closing member may be made of a transparent material such that the closing member serves as a transparent window. Consequently, contamination of the interior of the hot air discharging duct can be easily seen through the transparent closing member, whereby the interior of the hot air discharging duct is easily cleaned.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A clothes drying machine, comprising:

a housing;

a drying tub rotatably mounted in the housing;

a hot air introducing duct to introduce hot air into the drying tub;

a hot air discharging duct to discharge the hot air out of the drying tub;

a transparent window made of a transparent material, the transparent window being part of the hot air discharging duct; wherein the hot air discharging duct includes a fan casing having a blowing fan mounted therein and guiding the hot air, wherein the fan casing comprises:

a bent part of the hot air discharging duct formed at one side of the fan casing and curved, a cleaning hole formed at the bent part, and a closing member attached to the cleaning hole to close the cleaning hole, the closing member having a curved surface corresponding the bent part of the hot air discharging duct and comprising the transparent window.

2. The machine according to claim 1, wherein the hot air discharging duct has one end disposed in front of the drying tub, and the hot air discharging duct is bent halfway to form the bent Dart of the hot air discharging duct such that the hot air discharging duct extends toward the rear of the housing to guide the hot air from the front to the rear of the drying tub, and wherein the transparent window is attached to the bent part of the hot air discharging duct.

3. The machine according to claim 1, further comprising a temperature sensor attached to the transparent window for detecting the temperature of the hot air passing through the hot air discharging duct.

4. A clothes drying machine, comprising:

a housing forming an external appearance of the clothes drying machine;

a drying tub rotatably mounted in the housing;

a hot air introducing duct to introduce hot air into the drying tub;

a hot air discharging duct to discharge the hot air out of the drying tub;

a temperature sensor to detect the temperature of the hot air passing through the hot air discharging duct; wherein the hot air discharging duct includes a fan casing having a blowing fan mounted therein and guiding the hot air, the fan casing comprising:

a bent part of the hot air discharging duct formed at one side of the fan casing and curved, a cleaning hole formed at the bent part, and a closing member, to which the temperature sensor is attached, detachably attached to the cleaning hole to close the cleaning hole, wherein the closing member has a curved surface corresponding to the bent part of the hot air discharging duct.

5. The machine according to claim 4, wherein the fan casing includes one end that is disposed at an inner front part of the housing so that the hot air is introduced into the hot air discharging duct through the end of the hot air discharging duct.

6. The machine according to claim 5, wherein the hot air discharging duct is bent halfway to form the bent part of the hot air discharging duct such that the hot air discharging duct extends toward the rear of the housing to guide the hot air to the rear of the housing, wherein the temperature sensor is attached to the bent part of the hot air discharging duct.

7. The machine according to claim 5, further comprising:

a heater disposed in the hot air introducing duct to heat air passing through the hot air discharging duct; and an auxiliary temperature sensor, which is able to intercept electric current, disposed at the front part of the hot air discharging duct to intercept electric current supplied to the heater when the temperature of the hot air passing through the hot air discharging duct exceeds a prescribed value.

8. The machine according to claim 5, wherein the hot air discharging duct is bent halfway to form the bent Dart of the hot air discharging duct such that the hot air discharging duct extends toward the rear of the housing to guide the hot air to the rear of the housing, and wherein the closing member has a curved surface corresponding to the bent part of the hot air discharging duct so that the closing member may cover substantially the entirety of the bent part of the hot air discharging duct.

9. The machine according to claim 8, wherein the hot air discharging duct further comprises:

a discharging pipe, connected to the end of the fan casing, to extend toward the rear of the housing to guide the hot air to the rear of the housing, wherein the bent part of the hot air discharging duct is formed at the end of the fan casing.

10. The machine according to claim 5, wherein the housing includes an opening formed, at least partly, at the front part thereof, and a front cover to cover the opening, and wherein the temperature sensor is exposed toward the opening.

11. The machine according to claim 4, wherein the temperature sensor is detachably attached to the hot air discharging duct.

12. A clothes drying machine, comprising:

a housing forming an external appearance of the clothes drying machine;

a drying tub rotatably mounted in the housing;

a hot air introducing duct to introduce hot air into the drying tub;

a hot air discharging duct to discharge the hot air out of the drying tub;

a temperature sensor to detect the temperature of the hot air passing through the hot air discharging duct; and a closing member detachably fixed to the hot air discharging duct, wherein the temperature sensor is attached to the closing member, wherein the hot air discharging duct includes a fan casing having a blowing fan mounted therein and having one end extending toward one side of the housing so that the hot air is guided toward the side of the housing, wherein the fan casing includes a bent part of the hot air discharging duct formed at one side of the fan casing and curved, a cleaning hole formed at the bent part such that the hot air passing through the hot air discharging duct may contact the temperature sensor, and the closing member detachably attached to the cleaning hole to close the cleaning hole, wherein the closing member has a curved surface corresponding to the bent part of the hot air discharging duct.

13. The machine according to claim 12, further comprising:

a heater disposed in the hot air discharging duct to heat air passing through the hot air discharging duct; and an auxiliary temperature sensor, which is able to intercept electric current, attached to the closing member to intercept electric current supplied to the heater when the temperature of the hot air passing through the hot air discharging duct exceeds a prescribed value.

14. The machine according to claim 13, wherein the hot air discharging duct includes one end disposed in front of the drying tub so that the hot air is introduced into the hot air discharging duct through the end of the hot air discharging duct, and the hot air discharging duct is bent halfway to form the bent Dart of the hot air discharging duct so that the hot air discharging duct extends toward the rear of the housing to guide the hot air to the rear of the housing, and wherein the closing member is attached to the bent part of the hot air discharging duct.

15. The machine according to claim 14, wherein the bent part of the hot air discharging duct is curved, and wherein the closing member has a curved surface corresponding to the bent part of the hot air discharging duct so that the closing member may cover substantially the entirety of the bent part of the hot air discharging duct.

16. The machine according to claim 12, wherein the temperature sensor is detachably attached to the closing member.

17. The machine according to claim 12, further comprising:

an engaging unit formed at the closing member and the hot air discharging duct in the shape of grooves; and protrusions to engage the edge of the closing member with the edge of the cleaning hole of the hot air discharging duct.

18. The machine according to claim 17, wherein the engaging unit comprises engaging protrusions and engaging grooves formed at the edges of the closing member and the cleaning hole of the hot air discharging duct such that the engaging protrusions are engaged in the engaging grooves, respectively.

19. The machine according to claim 18, wherein the engaging protrusions are provided at the edge of the cleaning hole of the hot air discharging duct and the edge of the closing member while extending along the cleaning hole of the hot air discharging duct and the edge of the closing member, and the engaging grooves are provided inside the engaging protrusions, respectively, while extending in parallel with the engaging protrusions.

20. A clothes drying machine, including a housing, a drying tub rotatably mounted in the housing into which hot air that is heated by a heater is introduced, the clothes drying machine comprising:

a hot air discharging duct, having a bent front part thereof disposed at an inner front part of the housing, to discharge the hot air out of the drying tub; and a temperature sensor mounted at the bent front part of the hot air discharging duct so as to detect the temperature of the hot air passing through the hot air discharging duct, wherein the hot air discharging duct includes a fan casing having a blowing fan mounted therein and guiding the hot air, wherein the fan casing comprises:

a bent part of the hot air discharging duct formed at one side of the fan casing and curved, a cleaning hole formed at the bent front part such that the inside of the hot air discharging duct communicates with the outside of the hot air discharging duct;

a closing member, to which the temperature sensor is attached, detachably attached to the cleaning hole to close the cleaning hole, wherein the closing member has a curved surface corresponding to the bent part of the hot air discharging duct.

21. The machine according to claim 20, wherein the temperature sensor is detachably attached to the hot air discharging duct.

22. The machine according to claim 20, further comprising an auxiliary temperature sensor disposed in the bent part of the hot air discharging duct to intercept electric current supplied to the heater when the temperature of the hot air passing through the hot air discharging duct exceeds a prescribed value.

23. The machine according to claim 20, wherein the closing member has a curved surface corresponding to a surface of the bent part of the hot air discharging duct.

24. The machine according to claim 20, wherein the fan casing includes one end extending toward one side of the housing so that the hot air is guided toward the side of the housing.

25. The machine according to claim 24, wherein the hot air discharging duct further comprises a discharging pipe, connected to the end of the fan casing, to extend toward the rear of the housing to guide the hot air to the rear of the housing, wherein the bent part of the hot air discharging duct is formed at the end of the fan casing.

26. The machine according to claim 20, wherein the cleaning hole and the closing member respectively comprise an engaging protrusion and an engaging groove at edges thereof to allow the closing member to be slid into a cooperative engagement with the cleaning hole.

* * * * *

UNITED STATES PATENT AND TRADEMARK OFFICE

CERTIFICATE OF CORRECTION

PATENT NO. : 7,644,516 B2
APPLICATION NO. : 11/077155
DATED : January 12, 2010
INVENTOR(S) : Young Suk Chung It is certified that error appears in the above-identified patent and that said Letters Patent is hereby corrected as shown below:

Column 7, Line 12, after "bent" change "Dart" to --part--.

Column 7, Line 63, after "bent" change "Dart" to --part--.

Column 8, Line 58, after "bent" change "Dart" to --part--.

Signed and Sealed this

Sixth Day of April, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,644,516 B2
APPLICATION NO. : 11/077155
DATED : January 12, 2010
INVENTOR(S) : Young Suk Chung It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 572 days.

Signed and Sealed this

Twenty-first Day of December, 2010

David J. Kappos

David J. Kappos
*Director of the United States Patent and Trademark Office*